US010937602B2

(12) United States Patent
I

(10) Patent No.: US 10,937,602 B2
(45) Date of Patent: Mar. 2, 2021

(54) METHOD USING BISMUTH BASED ALLOY AS POWER-OFF ELEMENT

(71) Applicant: GREEN IDEA TECH INC., Mahe (SC)

(72) Inventor: Hsiang-Yun I, Tainan (TW)

(73) Assignee: GREEN IDEA TECH, INC., Mahe (SC)

( * ) Notice: Subject to any disclaimer, the term of this patent is extended or adjusted under 35 U.S.C. 154(b) by 0 days.

(21) Appl. No.: 16/202,009

(22) Filed: Nov. 27, 2018

(65) Prior Publication Data

US 2020/0013564 A1 Jan. 9, 2020

(30) Foreign Application Priority Data

Jul. 3, 2018 (TW) ..... 107123015

(51) Int. Cl.

| | |
|---|---|
| ***H01H 1/021*** | (2006.01) |
| ***H01H 23/16*** | (2006.01) |
| ***H01R 13/03*** | (2006.01) |
| ***H01R 13/713*** | (2006.01) |

(52) U.S. Cl.

CPC ..... *H01H 1/021* (2013.01); *H01H 23/16* (2013.01); *H01R 13/03* (2013.01); *H01R 13/7137* (2013.01); *H01H 2221/044* (2013.01); *H01H 2235/01* (2013.01); *H01H 2239/06* (2013.01)

(58) Field of Classification Search

CPC .... H01H 1/021; H01H 23/16; H01H 2235/01; H01H 2221/044; H01H 2239/06; H01R 13/7137; H01R 13/03

USPC ..... 337/52, 59, 98, 132, 142, 298, 317, 342, 337/345, 388

See application file for complete search history.

(56) References Cited

U.S. PATENT DOCUMENTS

| | | | | |
|---|---|---|---|---|
| 4,295,114 | A * | 10/1981 | Pohl | H01H 37/764 337/3 |
| 4,472,705 | A * | 9/1984 | Carlson | H01H 37/002 337/299 |
| 4,528,538 | A * | 7/1985 | Andersen | H01H 73/26 337/2 |
| 5,196,820 | A * | 3/1993 | Ubukata | H01H 37/002 337/3 |
| 5,221,914 | A * | 6/1993 | Ubukata | H01H 37/002 337/13 |

(Continued)

FOREIGN PATENT DOCUMENTS

| | | |
|---|---|---|
| TW | 321352 | 11/1997 |
| TW | 382568 | 6/2010 |

*Primary Examiner* — Stephen S Sul

(74) *Attorney, Agent, or Firm* — Michael D. Eisenberg

(57) ABSTRACT

The present invention discloses a method using a bismuth based alloy as power-off element, comprising: a bismuth based alloy is used as the power-off element and a melting point of the bismuth based alloy is between 100° C. to 380° C.; when the power-off element is in an environment below the melting point, two conductive elements are mutually contacted and capable of conducting currents, whereas the power-off element is only receptive of the currents but does not serve as a medium for conducting the currents; when a working temperature of a switch or the socket is close to or exceeds the melting point, the power-off element loses rigidity and enables the two conductive elements to be separated from each other, thereby forming an electrically disconnected state.

9 Claims, 6 Drawing Sheets

(56) References Cited

U.S. PATENT DOCUMENTS 5,391,847 A * 2/1995 Gallone ..... H01H 1/5833 200/244
5,694,106 A * 12/1997 Wang ..... H01H 71/16 337/79
5,831,507 A * 11/1998 Kasamatsu ..... H01H 9/10 337/4
5,847,638 A * 12/1998 Sorenson ..... H01H 77/04 337/380
5,982,269 A * 11/1999 Sorenson ..... H01H 73/26 200/553
6,303,408 B1 * 10/2001 Smith ..... H01L 21/563 257/678
6,452,125 B1 * 9/2002 Yu ..... H01H 73/26 200/339
6,664,884 B1 * 12/2003 Yu ..... H01H 73/26 200/52 R
6,734,779 B2 * 5/2004 Yu ..... H01H 73/26 337/56
6,797,905 B1 * 9/2004 Wang ..... H01H 23/205 200/339
7,068,141 B2 * 6/2006 Senda ..... H01H 37/761 337/290
7,132,616 B1 * 11/2006 Radosavljevic ..... H01H 23/168 200/553
7,173,510 B2 * 2/2007 Kono ..... H01H 37/76 337/159
7,248,140 B2 * 7/2007 Yu ..... H01H 71/7436 337/56
7,688,174 B2 * 3/2010 Hung ..... H01H 23/025 337/56
8,643,462 B2 * 2/2014 Lee ..... H01H 71/18 200/332
2001/0012732 A1 * 8/2001 Kitchens ..... H01H 37/761 439/620.31
2015/0206670 A1 * 7/2015 Shiraishi ..... H01H 13/10 200/402
2016/0006235 A1 * 1/2016 Wang ..... H02H 3/38 361/91.2
2016/0233041 A1 * 8/2016 Wang ..... H01H 23/105
2017/0047180 A1 * 2/2017 Wang ..... H01C 7/12
2017/0148601 A1 * 5/2017 Wang ..... H01H 89/04
2017/0148602 A1 * 5/2017 Wang ..... H01H 37/761
2017/0359902 A1 * 12/2017 Benwadih ..... B05D 1/02
2019/0066887 A1 * 2/2019 Wang ..... H01C 7/12
2019/0082539 A1 * 3/2019 Bultitude ..... H05K 1/18

* cited by examiner

METHOD USING BISMUTH BASED ALLOY AS POWER-OFF ELEMENT

FIELD OF THE INVENTION

The present invention relates to a method using a bismuth based alloy as power-off element and, more particularly, to such a method which uses a bismuth based alloy as a power-off element in an electrical circuit of a switch or a socket; the power-off element is different from a fuse, that is, the power-off element does not serve as a medium for currents to flow through, and the rigidity of the power-off element can be destroyed by an abnormal heat energy, so as to achieve powering off.

BACKGROUND OF THE INVENTION

In R.O.C. Patent No. 321352 which is entitled "Improved Structure of the On-wire Switch", a switch structure having a fuse is disclosed, and yet the fuse is located in a path of a live wire of a power source, which means a current is required to flow through for the protection effect to be available; given that only an overloaded current can possibly melt the fuse, and since a fuse is required to allow currents to flow through during operation but also must be capable of being melted when there are excessive currents, a lead-tin alloy or zinc having low melting points are often used as fuses, of which the conductive performances are much poorer than that of copper. Using an extension cord as an example, in which copper is mainly used as a conducting body, if the extension cord has combined therein the switch of the R.O.C. Patent No. 321352 for controlling a power source, the conductivity of the fuse would be poor, which leads to the issue of excessive energy consumption.

In R.O.C. Patent No. 382568 which is entitled "Bipolar Type Auto Power Off Safety Switch", an overload protection switch having a form of a double metal member is disclosed, but the double metal member likewise is required to be located in a path where currents flow through and are dependent on currents flowing through to generate deformations, and particularly overloaded currents are required because only the overloaded currents are capable of deforming the double metal member to interrupt a circuit.

SUMMARY OF THE INVENTION

The present invention discloses a method using a bismuth based alloy as power-off element, comprising: Step 1, using a bismuth based alloy i as a power-off element and a melting point of the bismuth based alloy is between 100° C. to 380° C.; Step 2, enabling the power-off element to be in an environment below the melting point, such that two conductive elements are mutually contacted and capable of conducting currents, and the power-off element is only receptive of the currents but does not serve as a medium for conducting the currents; Step 3, by having a working temperature of a switch or socket to be close to or exceed the melting point, the power-off element loses rigidity and enables the two conductive elements to be separated from each other, thereby forming an electrically disconnected state.

After the aforesaid two conductive elements are separated from each other to form an electrically disconnected state, the power-off element is limited and does not contact the two conductive elements at the same time.

After the two conductive elements are separated from each other to form an electrically disconnected state, the power-off element remains as an integrated body without disintegrating.

In addition, the bismuth based alloy comprises bismuth and any one of the following metals: cadmium, indium, silver, tin, lead, antimony and copper. Alternatively, the bismuth based alloy comprises 50% to 70% of bismuth and 30% to 50% of tin. In addition, the bismuth based alloy further comprises an added metal, and the added metal is selected from one of the following or any combinations thereof: arsenic, calcium, tellurium, and mercury; a proportion of the added metal in the bismuth based alloy is between 0.01% to 20%.

In addition, at least one of the two conductive elements has or is receptive of a force, wherein the force enables the two conductive elements to be away from each other relatively, but the force is incapable of destroying the rigidity of the power-off element below the aforesaid melting point.

In addition, the power-off element uses an external force to limit the two conductive elements below the melting point, such that the two conductive elements can contact selectively. The external force is an elastic force of a spring.

The following effects can be achieved according to the aforesaid technical features:

1. The power-off element is not a fuse, and is not located in a path of current transmission or responsible for transmitting currents; therefore, when the present invention is applied to a switch or a socket, even if the conductivity of the power-off element is not as good as that of copper, the electricity consumption performance of the switch or the socket will not be directly affected.

2. After the two conductive elements are separated from each other and thus forming an electrically disconnected state, the power-off element is limited in an original position without contacting the two conductive elements at the same time, such that after the non-insulative power-off element is destroyed by a high temperature, the power-off element does not contact the two conductive elements and causes accidental electrical conducting.

3. After the two conductive elements are separated from each other and thus forming an electrically disconnected state, the power-off element remains as an integrated body without disintegrating, such that after the non-insulative power-off element is destroyed by a high temperature, the power-off element does not contact the two conductive elements and causes accidental electrical conducting.

4. The melting point of the bismuth based alloy is approximately between 100° C. to 380° C.; for example, when the power-off element is made of a bismuth-tin alloy, a melting point thereof is 138° C., but begins to lose its rigidity when the temperature is close to the melting point, and so the alloy is very suitable for detecting overheating in a conducting circuit.

DETAILED DESCRIPTION OF THE PREFERRED EMBODIMENTS

In summary of the technical features described above, the main effects of the method using a bismuth based alloy as power-off element of the present invention can be clearly illustrated by the following embodiments.

Figure 1:
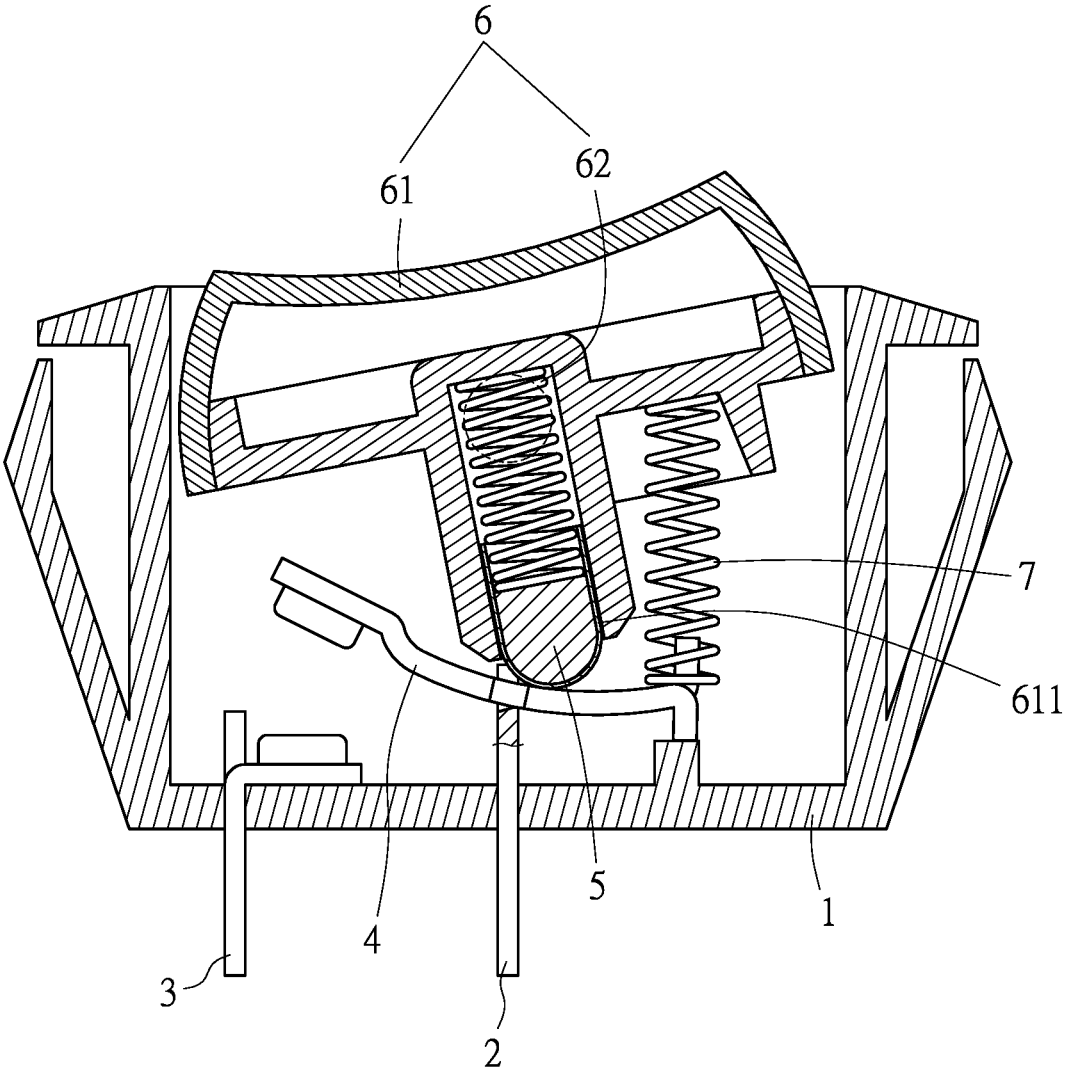
FIG. 1 illustrates a schematic view of a power-off element applied to a switch in accordance with a first embodiment of the present invention, wherein the switch is in a non-conducting state.

FIG. 1 illustrates a first embodiment of the present invention, wherein the embodiment uses a rocker switch as an example, comprising: a base (1), a first conductive element (2), a second conductive element (3), a movable conductive element, and a power-off element (5), wherein the first conductive element (2) and the second conductive element (3) are both penetrated into and provided in the base (1). The movable conductive element is a rocker conductive element (4), wherein the rocker conductive element (4) is provided above the first conductive element (2) and electrically connected to the first conductive element (2). In this embodiment, the "two conductive elements" defined in the present invention are the second conductive element (3) and the rocker conductive element (4). A material of the power-off element (5) is a bismuth based alloy, and a melting point of the bismuth based alloy is between 100° C. to 380° C.; for instance, the bismuth based alloy may be a bismuth-tin binary alloy which comprises 50% to 70% of bismuth and 30% to 50% of tin, wherein a melting point of the bismuth-tin binary alloy is approximately 138° C., but the rigidity thereof starts to be lost as a temperature thereof approaches the melting point, thus making the alloy very suitable for detection of overheating in an electrically conducting circuit. Alternatively, the bismuth based alloy comprises bismuth and any one of the following metals: cadmium, indium, silver, lead, antimony and copper; as long as a bismuth based alloy consisted of bismuth and the aforesaid metals has a melting point between 100° C. to 380° C., the alloy can serve as a valid embodiment of the present invention. The aforesaid bismuth based alloy may further comprise an added metal, and the added metal is selected from one of the following or any combinations thereof: arsenic, calcium, tellurium, and mercury; a proportion of the added metal in the bismuth based alloy is between 0.01% to 20%. Therefore, different added metals may be selected for the bismuth based alloy according to different usage environments.

When a working temperature is increased abnormally, a disconnection is preferably generated in the live wire; therefore, the first conductive element (2) is used as a first end of the live wire, and the second conductive element (3) is used as a second end of the live wire, such that the first conductive element (2) and the second conductive element (3) are connected and conducted via the rocker conductive element (4) to form a live wire circuit.

The rocker switch of the embodiment further comprises an operating component (6) for operating the rocker conductive element (4) to connect and conduct the first conductive element (2) and the second conductive element (3) to form a live wire circuit, or to disconnect the connection between the first conductive element (2) and the second conductive element (3) so as to form an open circuit on the live wire. The operating component (6) is assembled on the base (1) and comprises an operating element (61) and a first elastic element (62), wherein the operating element (61) is pivotally connected to the base (1) to enable the operating element (61) to be rotated reciprocally in a limited manner, and the operating element (61) comprises a thermal conductive shell (611) which is contacted with the rocker conductive element (4); the power-off element (5) is provided in the thermal conductive shell (611), and the first elastic element (62) has one end thereof pressed against the operating element (61) and another end thereof pressed against the power-off element (5); the power-off element (5) has a rigidity to enable the first elastic element (62) to be compressed and thus having a first elastic force; the first elastic force serves as an external force for controlling the rocker conductive element (4) to contact with the second conductive element (3) to form a connected circuit, or controlling the rocker conductive element (4) to not contact with the second conductive element (3) to form a disconnected circuit.

The rocker switch further has a second elastic element (7), and the second elastic element (7) is a spring in the embodiment. The second elastic element (7) has a second elastic force, and the second elastic force is a force acting on the operating element (61); when the aforesaid first elastic force is reduced, the second conductive element (3) becomes receptive of the force so as to enable the rocker conductive element (4) to be relatively separated and away from the second conductive element (3). The aforesaid second conductive element (3) is receptive of the force, which is equivalent to "at least one conductive element is receptive of a force" defined in the present invention.

Figure 2:
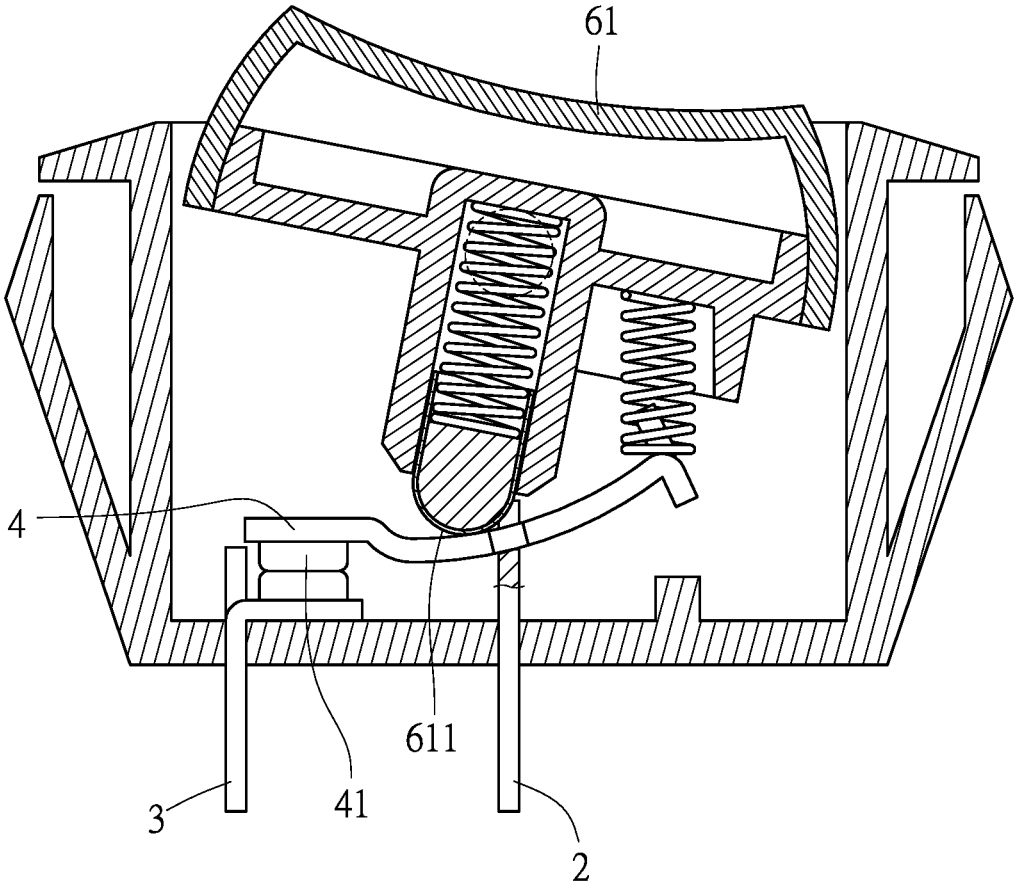
FIG. 2 illustrates a schematic view of a power-off element applied to a switch in accordance with the first embodiment of the present invention, wherein the switch is in a conducting state.

Referring to FIG. 2, a user enables the thermal conductive shell (611) to slidably move on the rocker conductive element (4) by operating the operating element (61), so as to drive the rocker conductive element (4) to be selectively contacted with or separated from the second conductive element (3) in a manner of rocking motions. When the thermal conductive shell (611) slidably moves on the rocker conductive element (4) towards a silver contact point (41) on the rocker conductive element (4), the aforesaid external force forces the silver contact point (41) to be contacted with the second conductive element (3) to form an electrically connected state.

Figure 3:
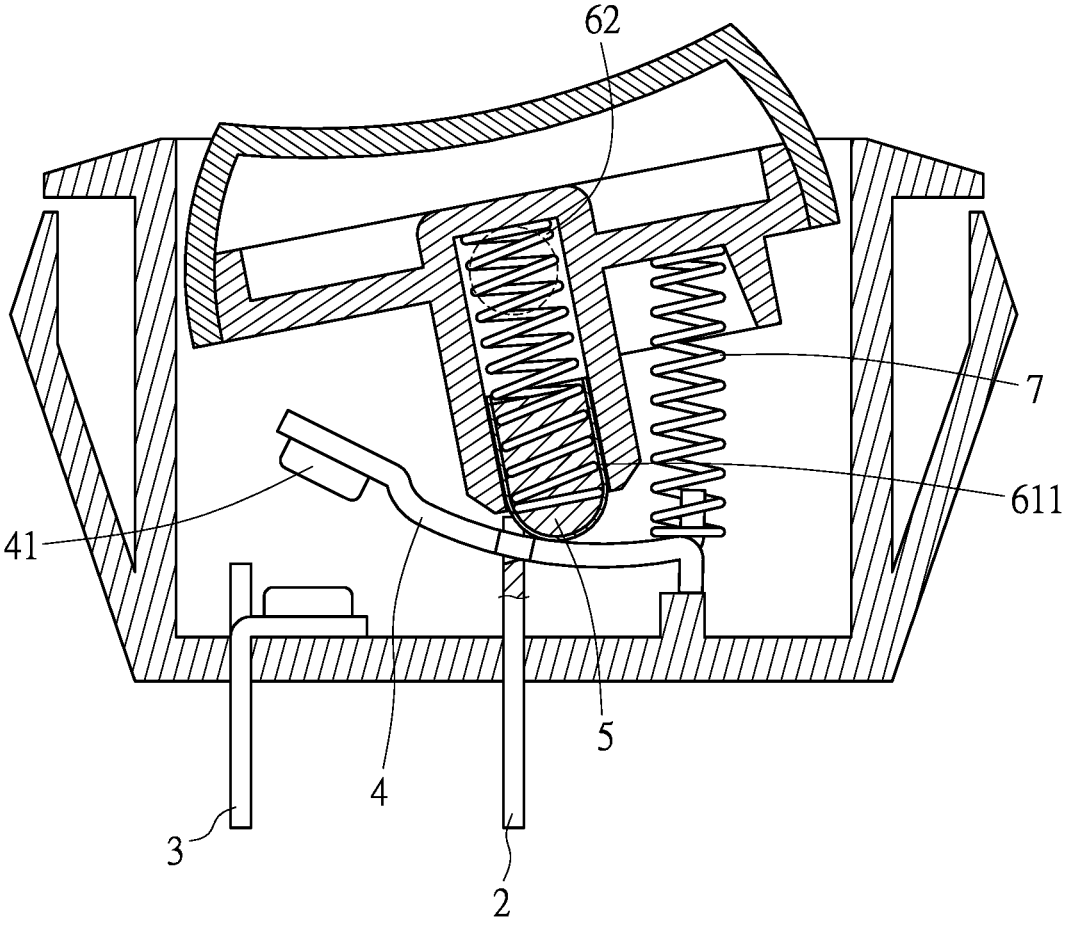
FIG. 3 illustrates a schematic view of a power-off element applied to a switch in accordance with the first embodiment of the present invention, wherein the power-off element is destroyed due to overheating and thus forming a non-conducting state.

Referring to FIG. 3, when an external conducting apparatus connected to the first conductive element (2) or the second conductive element (3) is in an abnormal state and generates a heat energy, the heat energy is transmitted to the rocker conductive element (4) via the first conductive element (2) or the second conductive element (3), and then further transmitted to the power-off element (5) via the thermal conductive shell (611); the power-off element (5) absorbs the heat energy and gradually loses the rigidity thereof; for example, a material of the power-off element (5) is a bismuth-tin alloy, and even though a melting point thereof is 138° C., the rigidity starts to be lost before reaching the approximate melting point; therefore, under the effect of the external force, the power-off element (5) is compressed and deformed by the first elastic element (62), and the first elastic element (62) is extended into the softened power-off element (5); the first elastic element (62) is elongated, thus reducing or eliminating the external force, such that the force of the second elastic element (7) becomes greater than the aforesaid external force and subsequently driving the thermal conductive shell (611) to slidably move on the rocker conductive element (4), thus forcing the silver contact point (41) of the rocker conductive element (4) to be separated from the second conductive element (3) and forming an electrically disconnected state, thereby achieving protection against overheating. In the embodiment, the power-off element (5) which lost the rigidity thereof due to receiving an abnormal heat energy will still be limited in the thermal conductive shell (611) after being deformed, and will not be contacted with the second conductive element (3) and the rocker conductive element (4) at the same time. It should be particularly noted that the power-off element (5) utilizes a different means for melting from that of a fuse, in which the power-off element (5) of the present invention is not responsible for transmitting currents; therefore, even if the conductivity of the power-off element (5) is poorer than that of copper, the electricity consumption performance of the circuit would not be directly affected. In addition, as indicated in FIG. 3, the power-off element (5) of the embodiment is a non-insulative body; when the power-off element (5) is destroyed and deformed or after the same is deformed, the power-off element (5) is limited inside the thermal conductive shell (611) without overflowing or spreading outwardly to become connected to the rocker conductive element (4) and the second conductive element (3) again, thus avoiding accidentally conducting a power source when the rocker switch is in a switch-off state. In a process of power-off protection, an increase in the working temperature leads to the power-off element (5) being destroyed, and then the power source is to interrupted; once the power source is interrupted, the working temperature is consequently decreased to enable the power-off element (5) to be cooled off and maintained in a deformed state.

Figure 4:
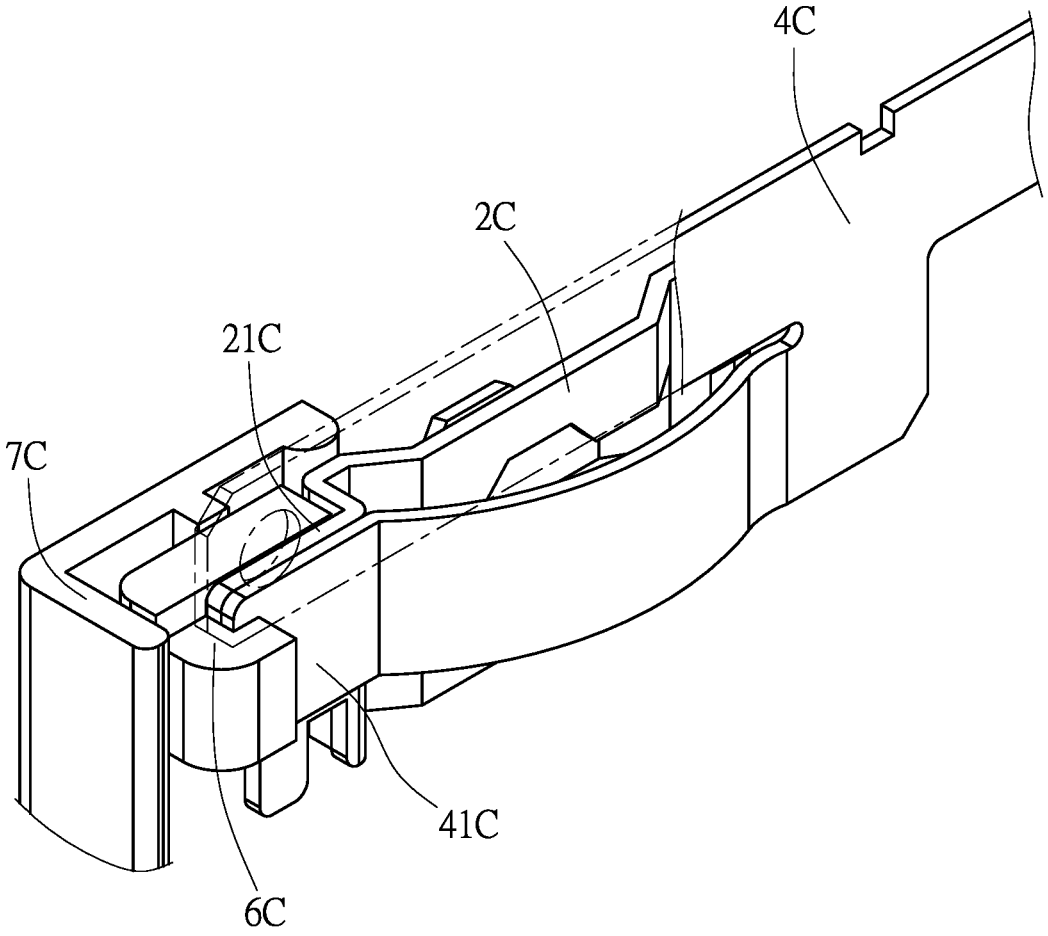
FIG. 4 illustrates a schematic view of a power-off element applied to an extension cord in accordance with a second embodiment of the present invention.
Figure 5:
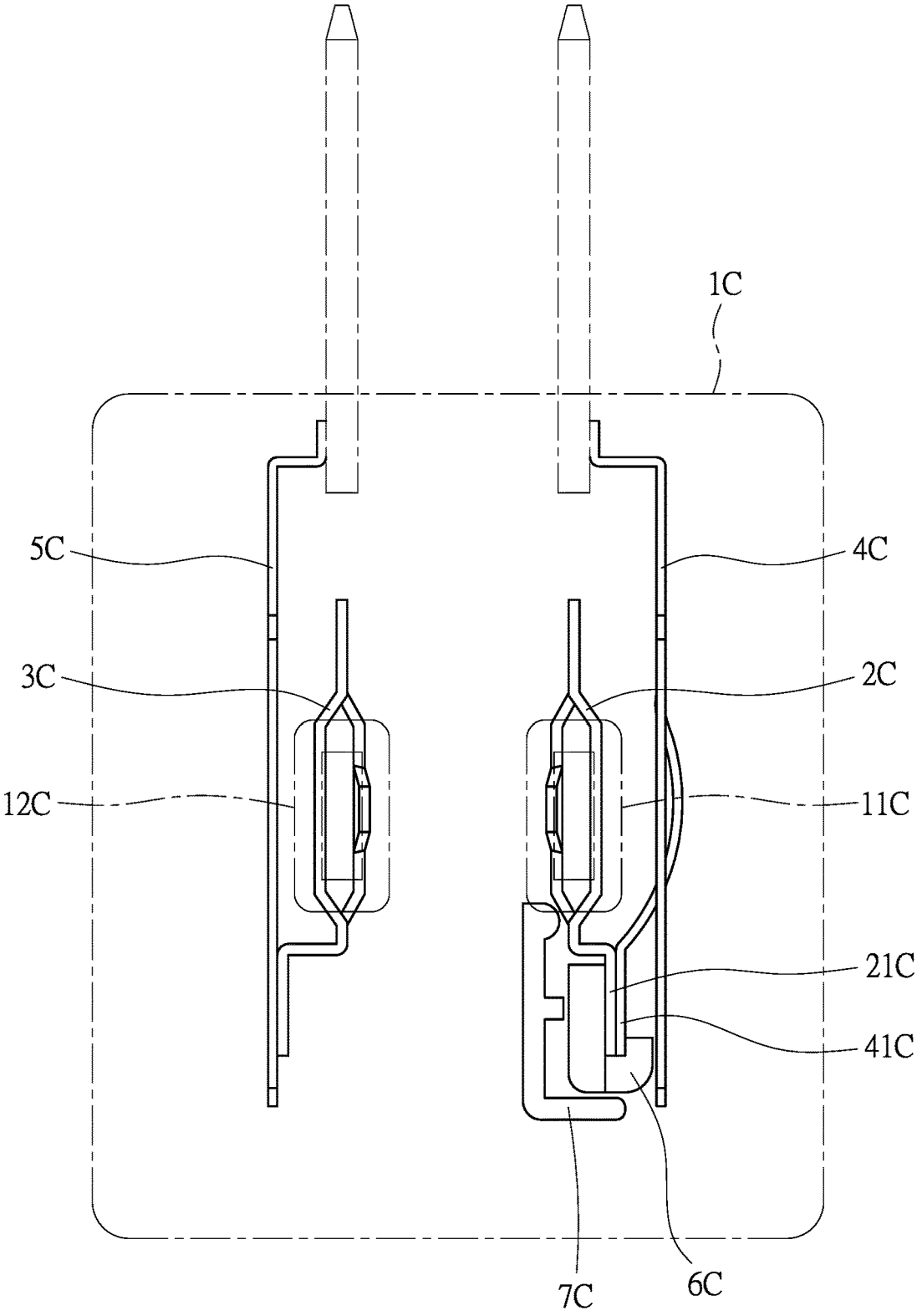
FIG. 5 illustrates a schematic view showing that in FIG. 4, live wire terminals and a live wire are contacted in a limited manner via a J-shaped power-off element, and a stopper is provided at an outer edge of the J-shaped power-off element.

FIGS. 4 and 5 illustrate a second embodiment of the present invention, wherein the embodiment uses an extension cord as an example, comprising:

an insulative body (10) having a live wire jack (11C) and a neutral line jack (12C); a live wire terminal (2C) mounted in the insulative body (10) and in correspondence with the live wire jack (110), wherein the live wire terminal (2C) has a terminal extension portion (21C); a neutral line terminal (3C) mounted in the insulative body (10) and in correspondence with the neutral line jack (12C); a live wire (4C) and a neutral line (5C) respectively corresponding to the live wire terminal (2C) and the neutral line terminal (3C), wherein the live wire (4C) has a live wire elastic member (41C), the live wire elastic member (41C) has an elastic force and the force enables the live wire elastic member (41C) to be inclined away from the terminal extension portion (21C); a power-off element (6C) presented in a J-shape; the power-off element (6C) of the embodiment utilizes a bismuth-tin binary alloy, in which the power-off element (6C) has a terminal portion thereof clamping the terminal extension portion (21C) of the live wire terminal (2C) and the live wire elastic member (41C) of the live wire (4C), and the live wire terminal (2C) and the live wire (4C) are enabled to be mutually contacted to form a connected circuit by means of the rigid limitation of the power-off element (6C), wherein the neutral line terminal (3C) and the neutral line (5C) can be connected and fixed to form a connected circuit by soldering or other fixing manners; a stopper (7C) located on an outer edge of the power-off element (6C). In the embodiment, "two conductive elements" defined in the present invention are equivalent to the live wire elastic member (41C) and the terminal extension portion (21C), wherein the live wire elastic member (41C) has an elastic force which is equivalent to "at least one conductive element has a force" defined in the present invention.

Figure 6:
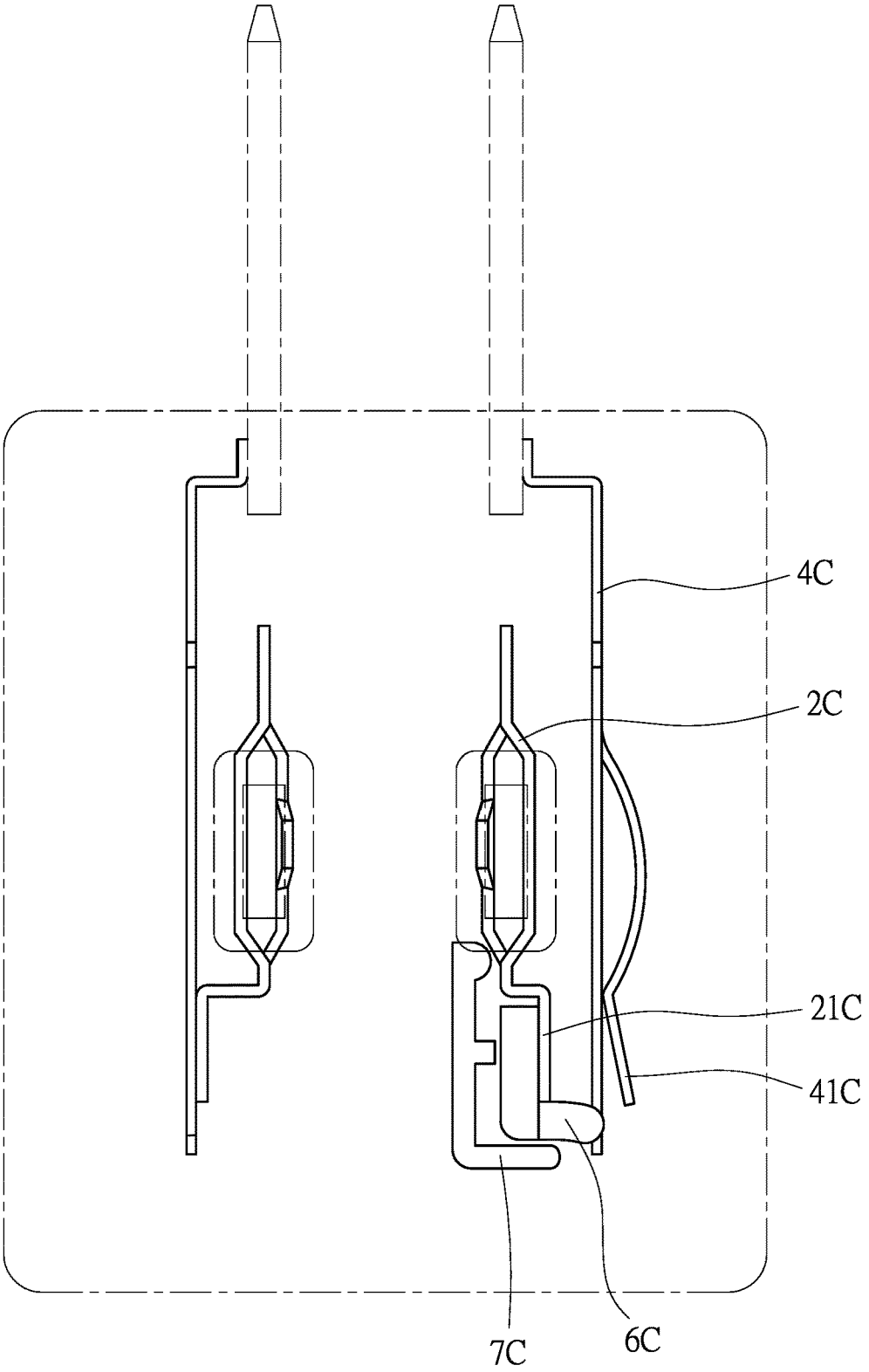
FIG. 6 illustrates a schematic view of a power-off element applied to an extension cord in accordance with the second embodiment of the present invention, wherein the power-off element is destroyed due to overheating and a destroyed part thereof is blocked by the stopper.

Referring to FIG. 6, when a circuit is overheated, the power-off element (6C) gradually loses the rigidity thereof, and the force thus forcing the power-off element (6C) to be deformed into a shape similar to an L-shape during the process of losing the rigidity thereof, removing the limitation on the live wire elastic member (41C) to enable the terminal extension portion (21C) of the live wire terminal (2C) to be pushed away from the live wire elastic member (41C) of the live wire (4C) by the force to form a disconnected circuit, thereby achieving protection from overheating. After the power-off element (6C) is destroyed, the stopper (7C) can restrain the power-off element (6C) to prevent the power-off element (6C) from randomly springing away due to the force. Similarly, the power-off element (6C) is not responsible for transmitting currents in the embodiment, and so even if the conductivity of the power-off element (6C) is poorer than that of copper, the electricity consumption performance of the connected circuit would not be directly affected. In addition, FIG. 6 shows that the power-off element (6C) of the embodiment is a non-insulative body, in which when the power-off element (6C) is destroyed and deformed or after the same is deformed, the power-off element (6C) still remains as an integrated body without disintegrating, and the power-off element (6C) is limited in an original position by the stopper (7C) and the terminal extension portion (21C) together, without spreading outwards and becoming connected to the terminal extension portion (21C) and the live wire elastic member (41C) again, thus preventing the extension cord from accidentally conducting a power source in a power-off state. In a process of power-off protection, an increase in the working temperature leads to the power-off element (6C) being destroyed, and then the power source is interrupted; once the power source is interrupted, the working temperature is consequently decreased to enable the power-off element (6C) to be cooled off and maintained in a deformed state.

In summary of the description of the aforesaid embodiments, it is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A method for using a bismuth based alloy as a power-off element, comprising:

Step 1, using the bismuth based alloy as the power-off element, wherein the bismuth based alloy has a melting point between 100° C. to 380° C.;

Step 2, enabling the power-off element to be in an environment below the melting point, wherein two conductive elements are mutually contacted and are capable of conducting a current, and the power-off element is only receptive of the current but does not serve as a medium for conducting the current;

Step 3, by having a working temperature of a switch or socket to be close to or exceed the melting point, the power-off element loses a rigidity thereof and enables the two conductive elements to be separated from each other, thereby forming an electrically disconnected state;

wherein after the two conductive elements are mutually separated and the electrically disconnected state is formed, the power-off element remains as an integrated body without disintegrating.

2. The method for using the bismuth based alloy as the power-off element in accordance with claim 1, wherein after the two conductive elements are mutually separated and an electrically disconnected state is formed, the power-off element is limited and is not contacted with the two conductive elements at the same time.

3. The method for using the bismuth based alloy as the power-off element in accordance with claim 1, wherein the bismuth based alloy comprises bismuth and any of the following metals: cadmium, indium, silver, tin, lead, antimony, and copper.

4. The method for using the bismuth based alloy as the power-off element in accordance with claim 1, wherein the bismuth based alloy comprises 50% to 70% of bismuth and 30% to 50% of tin.

5. The method for using the bismuth based alloy as the power-off element in accordance with claim 1, wherein the bismuth based alloy comprises 50% to 70% of bismuth and 30% to 50% of tin and an additional metal selected from one of the following or any combinations thereof: arsenic, calcium, tellurium, and mercury.

6. The method for using the bismuth based alloy as the power-off element in accordance with claim 5, wherein a proportion of the additional metal addition in the bismuth based alloy is between 0.01% to 20%.

7. The method for using the bismuth based alloy as the power-off element in accordance with claim 1, wherein at least one of the two conductive elements has or is receptive of a force, and the force enables the two conductive elements to be away from each other relatively, however, the force is incapable of destroying the rigidity of the power-off element below the melting point.

8. The method for using the bismuth based alloy as the power-off element in accordance with claim 1, wherein the power-off element utilizes an external force to limit the two conductive elements below the melting point, so as to enable the two conductive elements to be selectively contacted.

9. The method for using the bismuth based alloy as the power-off element in accordance with claim 8, wherein the external force is an elastic force of a spring.

* * * * *